US005848670A

United States Patent [19]

Salzman

[11] Patent Number: 5,848,670

[45] Date of Patent: Dec. 15, 1998

[54] LIFT PIN GUIDANCE APPARATUS

[75] Inventor: Phil Salzman, San Jose, Calif.

[73] Assignee: Applied Materials, Inc., Santa Clara, Calif.

[21] Appl. No.: 759,490

[22] Filed: Dec. 4, 1996

[51] Int. Cl.[6] ..... B66B 9/04

[52] U.S. Cl. ..... 187/272; 187/406; 414/935; 118/729; 118/728

[58] Field of Search ..... 187/272, 274, 187/406; 414/935; 118/729, 728

[56] References Cited

U.S. PATENT DOCUMENTS

| | | | |
|---|---|---|---|
| 4,363,380 | 12/1982 | Rued et al. | 187/274 |
| 4,591,044 | 5/1986 | Ogami et al. | 414/935 |
| 4,810,160 | 3/1989 | Emiliani et al. | 414/785 |
| 4,813,846 | 3/1989 | Helms | 414/935 |
| 4,990,047 | 2/1991 | Wagner et al. | 414/935 |
| 5,350,427 | 9/1994 | Freytsis et al. | 29/25.01 |
| 5,430,271 | 7/1995 | Orgami et al. | 414/935 |
| 5,540,821 | 7/1996 | Tepman | 414/935 |
| 5,569,350 | 10/1996 | Osada et al. | 118/728 |
| 5,636,963 | 6/1997 | Haraguchi et al. | 414/935 |
| 5,669,977 | 9/1997 | Shufflebotham et al. | 118/729 |
| 5,690,315 | 11/1997 | Thomas | 187/272 |

FOREIGN PATENT DOCUMENTS

| | | | |
|---|---|---|---|
| 274708A | 12/1989 | German Dem. Rep. | 414/935 |

*Primary Examiner*—Kenneth Noland
*Assistant Examiner*—Khoi H. Tran
*Attorney, Agent, or Firm*—Applied Materials, Inc.

[57] ABSTRACT

Apparatus for lifting a wafer, or other such workpiece, from the surface of pedestal in a semiconductor wafer processing system. More specifically, the apparatus relates to a lift pin that is guided by a guide bushing and a guide pin. Preferably, the lift pin is hollow and is slideably engaged with a guide pin. The guide pin is fixed relative to the pedestal and coaxially aligned with a lift pin bore in the pedestal. An actuator drives the lift pin along the guide pin from a fully retracted lift pin position to a fully extended lift pin position. A guide bushing, located in the pedestal proximate the lift pin, also guides the lift pin as the pin passes through the lift pin bore. The guide bushing forms a lip seal between the lift pin and the pedestal. Furthermore, a bellows surrounding the lift pin and the guide pin, can also be used to preserve the integrity of the chamber environment.

14 Claims, 3 Drawing Sheets

LIFT PIN GUIDANCE APPARATUS

BACKGROUND OF THE DISCLOSURE

1. Field of the Invention

The invention relates to an apparatus for lifting a wafer from the surface of a pedestal in a semiconductor wafer processing system. More specifically, the invention relates to a lift pin that is guided by a guide bushing and a guide pin.

2. Description of the Background Art

A conventional semiconductor wafer processing system contains a reaction chamber within which a wafer is supported by a pedestal subsystem having a pedestal that cooperates with a lift pin assembly. A wafer transport robot operating in cooperation with a lift pin assembly positions the wafer above the pedestal. The robot moves the wafer into the chamber through a slit valve. The lift pins of the lift pin assembly extend above the surface of the pedestal and lifts the wafer from the robot arm. The lift pins are usually elevated, by a lift mechanism, to provide clearance for the robot blade of the robot arm. The lift mechanism, usually under control of a computer control system, then lowers the lift pins below the pedestal so that the wafer is placed onto the surface of the pedestal. The pedestal may either mechanically or electrostatically clamp, i.e., chuck, the wafer to the pedestal.

After the wafer is placed onto the support surface of the pedestal, the lift pins continue to descend into the pedestal to a fully retracted position. Then, the wafer is usually chucked and one or more semiconductor fabrication process steps are performed in the chamber, such as deposition or etching films on the wafer. After completion of the process steps, the lift mechanism extends the lift pins to raise the wafer above the pedestal so that the wafer can be removed from the chamber via the robotic transport. When using an electrostatic chuck, before the lift pins can raise the wafer, the wafer must be electrically dechucked, i.e., the electrostatic force retaining the wafer on the pedestal must be removed or canceled. However, even after applying a conventional dechucking method, a residual charge still remains on the wafer and pedestal due to charge migration and/or field emission charging. As such and without damaging the wafer, the lift pins must forcibly lift the wafer to separate the wafer from the pedestal.

Additionally, larger wafer sizes, e.g., 300 mm, are being used in semiconductor processing. Processing these wafers require longer lift pins to adequately provide clearance for robotic transport. Increasing the length of the lift pins increases the tendency for the lift pins to bow, especially with the additional lifting and clamping forces involved with larger wafers. The wafer can easily be damaged if unequal forces are exerted by separate lift pins.

Therefore, a need exists in the art for an improved lift pin guidance assembly that accurately guides a lift pin for receiving, lowering and lifting wafers.

SUMMARY OF THE INVENTION

The disadvantages heretofore associated with the prior art are overcome by an apparatus for lifting a wafer from the surface of a pedestal in a semiconductor wafer processing system. More specifically, the invention relates to a lift pin that is guided by a guide bushing and a guide pin.

Preferably, the lift pin is hollow and is slideably engaged with the guide pin. The guide pin is fixed relative to the pedestal. The lift pin, driven by an actuator, slides along the guide pin from a fully retracted position to a fully extended position. The lift pin travels in a perpendicular path relative to the surface of the wafer. The lift pin supports a wafer in the fully extended position to provide sufficient clearance between the wafer and the surface of the pedestal for a robotic transport to remove the wafer.

A guide bushing also guides the lift pin as the pin moves from a retracted position to an extended position, and vice versa. The guide bushing is located in the pedestal and surrounds the lift pin. Furthermore, the guide bushing forms a seal to protect the integrity of the chamber environment. The invention uses one or both of two embodiments for preventing the chamber environment from escaping through the lift pin bores. The embodiments are (1) a lift pin assembly having a lip seal formed by the guide bushing, and/or (2) a lift pin assembly having a bellows surrounding the lift pin and guide pin.

As a result of using the invention in a semiconductor wafer processing system, a wafer is accurately received, lowered and lifted from the surface of the pedestal without damaging the wafer or the circuitry and components fabricated thereon.

BRIEF DESCRIPTION OF THE DRAWINGS

The teachings of the present invention can be readily understood by considering the following detailed description in conjunction with accompanying drawings in which.

To facilitate understanding, identical reference numerals have been used, where possible, to designate identical elements that are common to the figures.

DETAILED DESCRIPTION

Figure 1:
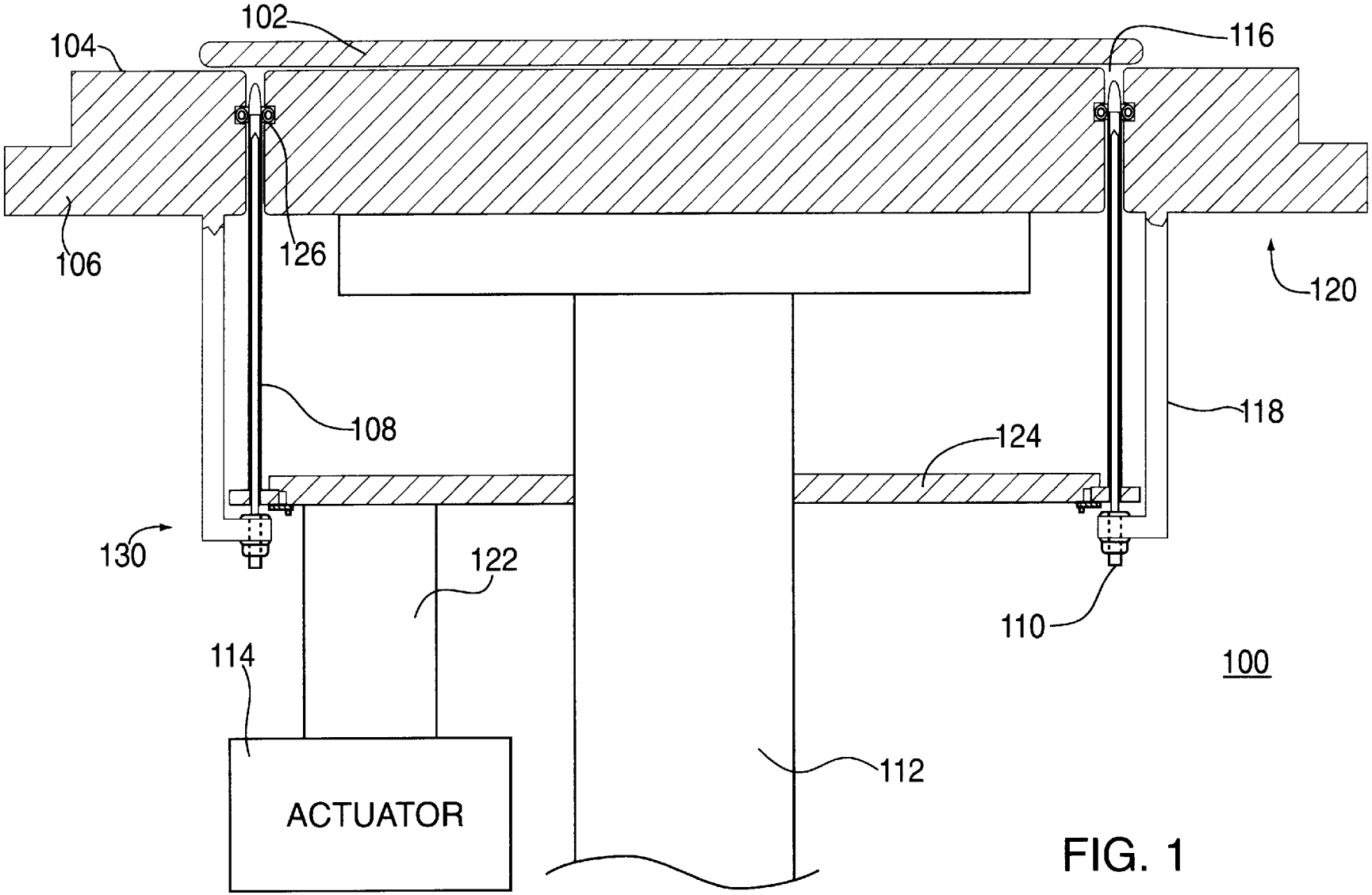
FIG. 1 depicts the lift pin guidance assembly of the present invention as used in a semiconductor wafer processing system.
Figure 2:
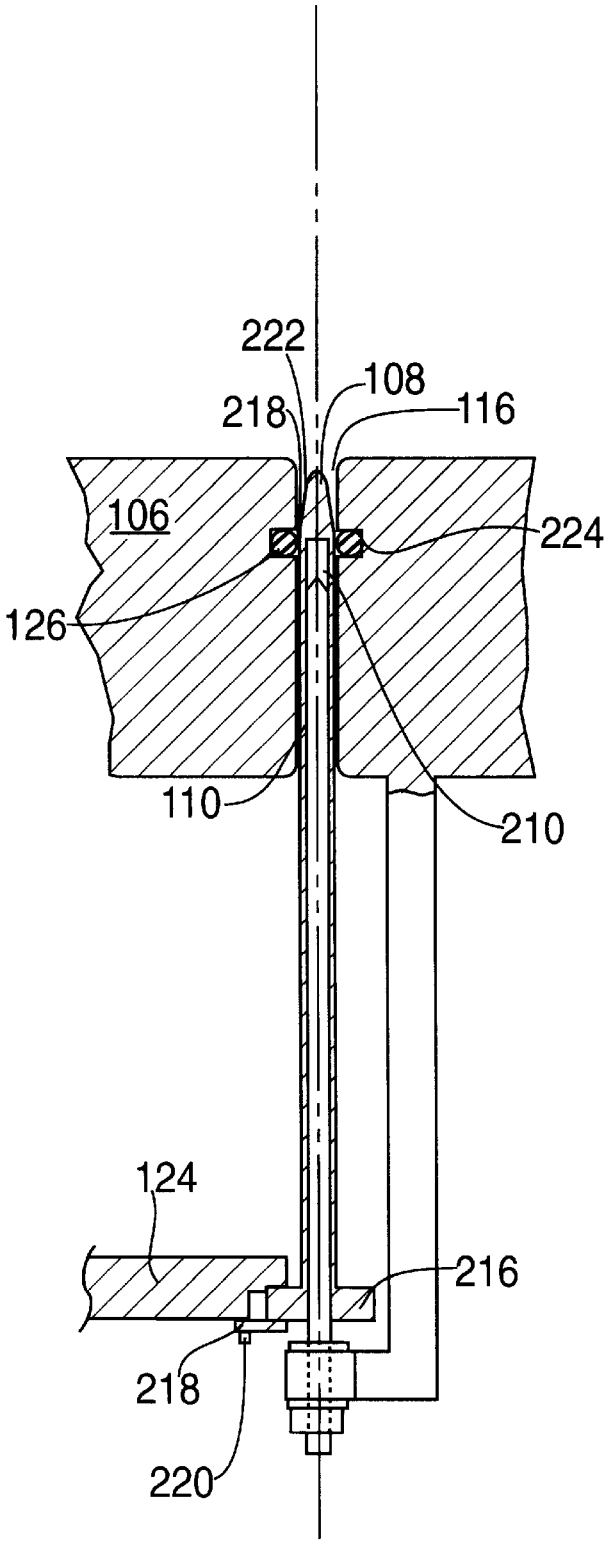
FIG. 2 depicts a cross-sectional view of a portion of the lift pin guidance assembly of FIG. 1 with the lift pin fully retracted into the pedestal.
Figure 3:
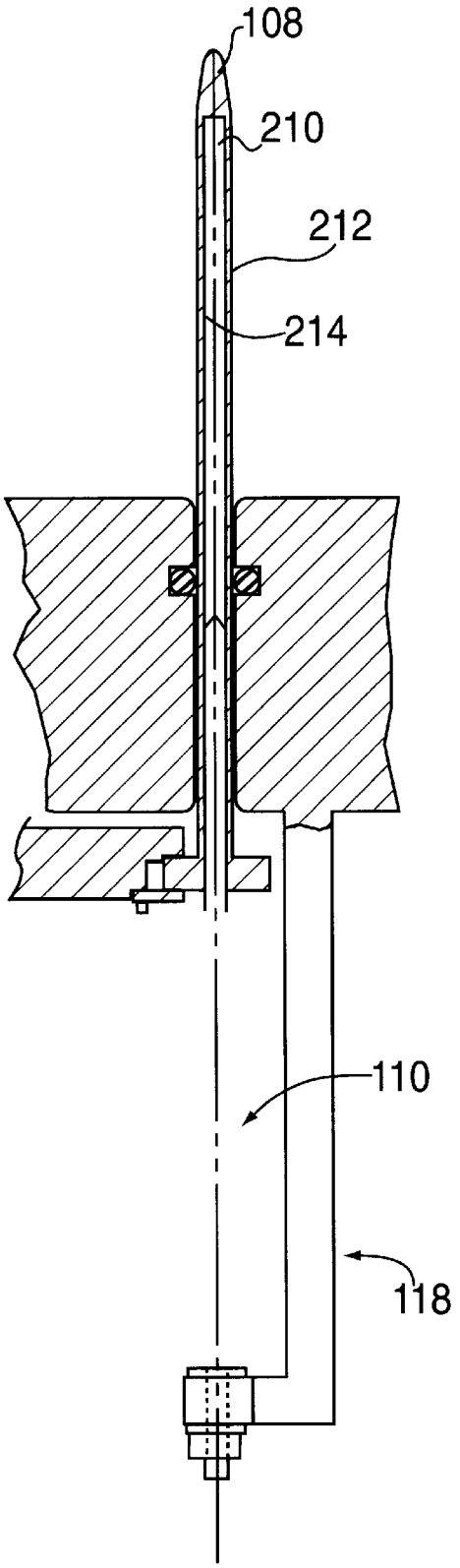
FIG. 3 depicts a cross-sectional view of a portion of the lift pin guidance assembly of FIG. 1 with the lift pin fully extended above the pedestal.

FIG. 1 depicts a wafer 102 supported by a pedestal subsystem 120 and a lift pin guidance assembly 130 of the present invention in a semiconductor wafer processing system 100. FIG. 2 depicts a cross-sectional view of a portion of the lift pin assembly of FIG. 1 with the lift pin 108 fully retracted into the pedestal 106. FIG. 3 depicts a cross-sectional view of a portion of the lift pin guidance assembly of FIG. 1 with the lift pin fully extended above the pedestal. For best understanding of the invention, the reader should refer to FIGS. 1, 2 and 3 while reading the following disclosure.

Specifically, the pedestal subsystem 120 contains a pedestal 106 having a plurality of bores forming lift pin bores 116, a pedestal surface 104, and a pedestal lift 112. The lift pin assembly 130 comprises a plurality of lift pins 108, a plurality of guide pins 110, a plurality of guide pin supports 118, a plurality of guide bushings 126, an actuator 114, an actuator shaft 122, and a drive plate 124.

The pedestal subsystem 120 supports a wafer 102, or other such workpiece, on the surface of the pedestal 104.

The pedestal lift 112, if required, is attached to the pedestal at one end and a lifting mechanism at the other end (not shown). The lifting mechanism, typically a pneumatic lift mechanism, raises and lowers the pedestal lift, vertically adjusting the pedestal. The pedestal also has a plurality of bores (e.g., three or more bores, spaced-apart on the pedestal) for the lift pins 108 of the lift pin assembly 130.

Preferably, the extending and retracting functions of the lift pin assembly 130 are driven by the actuator 114 and guided by the guide pin 110. The lift pin and guide pin are slideably engaged. The guide pin support 118, a generally L-shaped structure connected to the pedestal 106, supports the guide pin and remains fixed in relation to the pedestal and the lift pin bores 116. The guide pin is anchored to the guide pin support, providing rigid support to vertically align the lift pin. Thus, if a pedestal lift 112 is used, the entire lift pin assembly, which includes the actuator, is vertically adjustable by the pedestal lift 112.

FIGS. 2 and 3 depict the lift pin 108, fully retracted and fully extended respectively, engaged with the guide pin 110 in the lift pin assembly. The lift pin is preferably hollow having an interior surface 214 defining an interior space 210 and an exterior surface 212, with a solid tip 222 at the top of the lift pin. The interior surface of the lift pin slideably engages the guide pin. The engaged lift pin and guide pin are coaxially positioned in the lift pin bore 116 of the pedestal 106. The guide pin 110 is fixed by the guide pin support 118 in relation to the lift pin bore 116. A lift pin flange 216 extends from the lift pin and is attached preferably by clamping the lift pin flange to the drive plate 124 using a flange clamp 218 with a screw 220, such that the drive plate 124 is slideably attached to the lift pin flange 216. Alternatively, the flange could be welded or epoxied to the drive plate. The drive plate is connected to the actuator shaft 122, which is driven by the actuator 114. The actuator drives the lift pin along the guide pin through the lift pin bore from the fully retracted position shown in FIG. 2 to the fully extended position shown in FIG. 3 and vice versa.

The exterior surface of the lift pin 108, passes proximate the lift pin bore 116. The guide bushing 126, positioned in an annular slot 224 in the pedestal located along the lift pin bore, guides the lift pin through the lift pin bore. One form of guide bushing is an O-ring having an U-shaped cross-section. The exterior surface 212 of the lift pin slides along the guide bushing when the actuator drives the lift pin. The guide bushing forms a lip seal 218 between the pedestal 106 and the exterior surface 212 of the lift pin 108. The lip seal makes the chamber environment a closed process, i.e., the seal prevents the chamber environment, such as backside cooling gas, process gas, and the like, from passing through the lift pin bore beyond the lip seal. Typically, the guide bushing is fabricated of a material compatible with the gases present in the chamber environment, e.g., polytetrafluoroethylene (PTFE), and the like. Illustratively, the guide bushing is available from EGC Corporation, model number 100550A. Alternatively, multiple lip seals can also be used to further improve the seal. Additionally, in the multiple seal configuration, differentially pumping between the seal can form an absolute seal.

In use, a wafer 102 is transported through a slit valve (not shown) into the semiconductor processing chamber by a robotic transport (not shown). 200 mm and 300 mm wafers are typically used in such a system. Therefore, the lift pins 108 are dimensioned to adequately provide sufficient clearance for the robotic transport when the actuator 114 fully extends the lift pins. The robotic transport moves the wafer above the pedestal and the lift pins 108 lift the wafer above the transport blade of the robotic arm. The actuator 114 lowers the lift pins and when the lift pins descend below the surface of the pedestal 104, the wafer is placed on and rests flush against the surface of the pedestal. The actuator continues to lower the lift pins into the pedestal 106 to a fully retracted position, as shown in FIGS. 1 and 2. At this position, semiconductor fabrication process steps are performed on the wafer. After completion of the process, the actuator raises the lift pins above the surface of the pedestal, lifting and supporting the wafer in a perpendicular path relative to the wafer surface, to a fully extended position, as shown in FIG. 3. The blade of the robotic transport is then positioned between the wafer and the surface of the pedestal. The actuator lowers the lift pins and the lift pins descend to place the wafer onto the blade. The robotic transport removes the wafer from the chamber. Throughout such wafer positioning and processing, the guide bushing maintains the integrity of the chamber environment.

Figure 4:
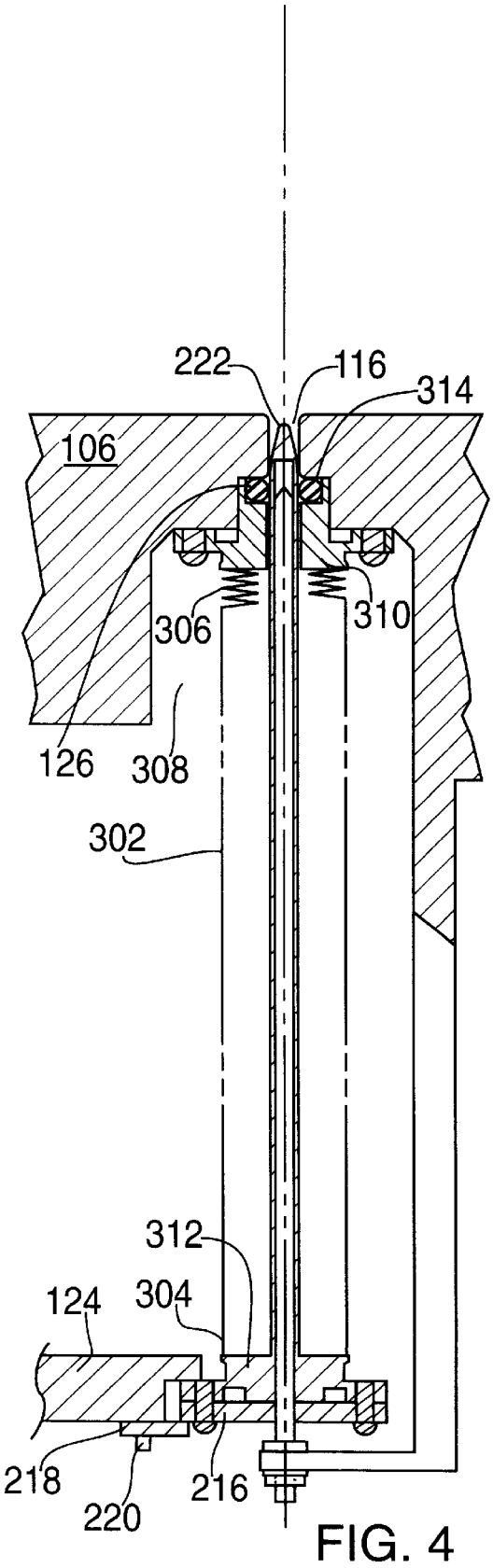
FIG. 4 depicts a vertical cross-sectional view of the lift pin guidance assembly having a bellows with the lift pin fully retracted.
Figure 5:
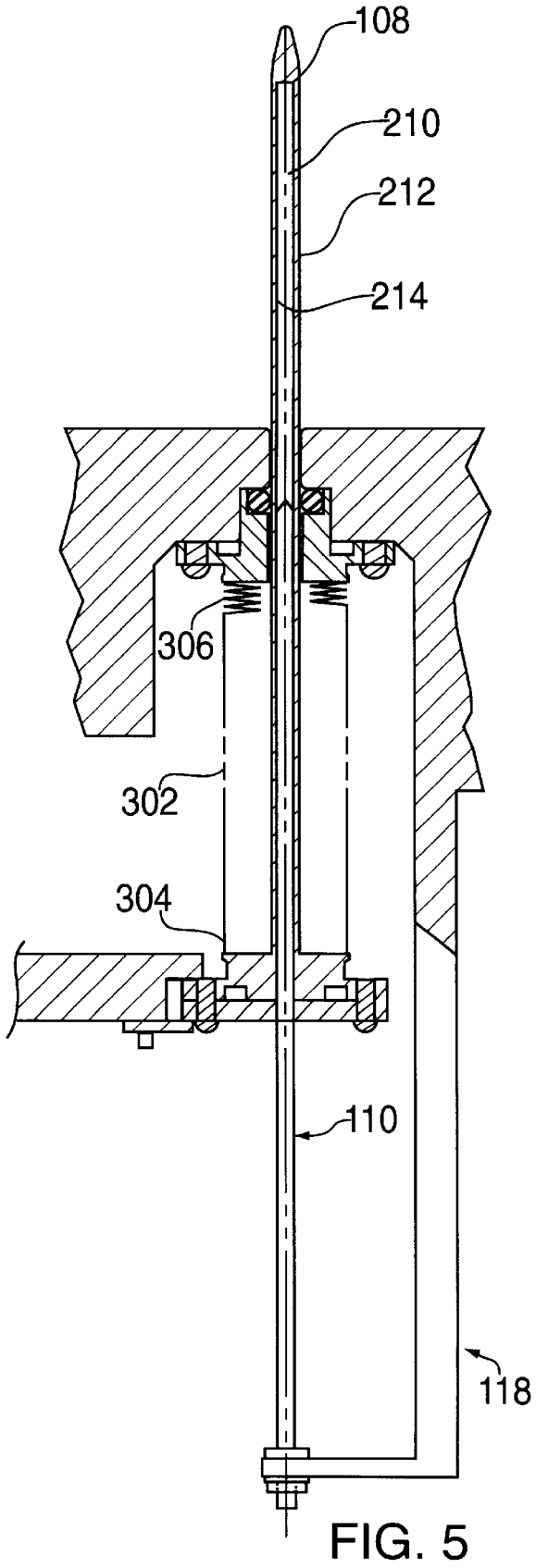
FIG. 5 depicts a vertical cross-sectional view of the lift pin guidance assembly having a bellows with the lift pin fully extended.

Alternatively, FIGS. 4 and 5 depict a portion of a second embodiment of the lift pin assembly, fully retracted and fully extended respectively. The embodiment contains a lift pin 108 engaged with a guide pin 110 having a bellows 302. The bellows 302, has a first end 304 and a second end 306 where the first end 304 of the bellows 302 is secured by preferably welding the first end to a lower bellows flange 312. The lower bellows flange is preferably attached by screws to the lift pin flange 216. The second end 306 of the bellows is coupled to an upper bellows flange 310, which is secured to the pedestal 106 in a bellows indentation 308 circumscribing and concentrically aligned with the lift pin bore 116 in the pedestal. Preferably, the lower bellows flange 312 and the lift pin flange 216 are screwed together and then clamped to the drive plate 124 using the flange clamp 218 and a screw 220, such that the drive plate 124 is slideably attached to the lift pin flange 216 and lower bellows flange 312.

The second end of the bellows is preferably welded to the upper bellows flange and the upper bellows flange is secured by screws in the bellows indentation to the pedestal. The bellows indentation is bored, milled or otherwise formed in the pedestal such that the upper bellows flange supports the guide bushing proximate the lift pin bore to facilitate lift pin guidance.

The upper bellows flange contains coaxial, annular slot 314 for retaining a guide bushing 126. The guide bushing in this embodiment operates in the same manner as discussed above. The seals connecting the bellows to the lift pin assembly and pedestal subsystem form impervious chamber environment seals. Specifically, these seals are located where the first and second ends of the bellows are coupled to the lower and upper bellows flange, and where the upper bellows flange is attached to the pedestal. The bellows prevents the chamber environment, such as backside cooling gas, process gas and the like, from passing beyond the bellows.

The lift pin guidance assembly of the present invention, substantially increases the clearing distance between the surface of a pedestal and a workpiece. Furthermore, the lift pin assembly is structurally improved over the conventional art. Larger wafers, e.g., 300 mm, can be successfully processed in a semiconductor wafer processing system using the present invention. Thus, the lift pin guidance assembly of the present invention accurately guides the lift pin for receiving, lowering and lifting wafers, without damaging the wafer or the circuitry and components fabricated thereon.

Although various embodiments which incorporate the teachings of the present invention have been shown and described in detail herein, those skilled in the art can readily devise many other varied embodiments that still incorporate those teachings.

What is claimed is:

1. An apparatus for lifting a workpiece from a surface of a pedestal, comprising a guide pin;

a lift pin, having an interior surface and an exterior surface, said interior surface being slideably engaged and guided by said guide pin; and wherein said lift pin passes through a bore in said pedestal to engage said workpiece; and an actuator for moving said lift pin relative to said guide pin.

2. The apparatus of claim 1 further comprising:

a guide bushing, circumscribing said lift pin, for guiding said lift pin through a bore in said pedestal.

3. The apparatus of claim 2 wherein said guide bushing forms a lip seal.

4. The apparatus of claim 1 further comprising:

means, coupled to said lift pin, for engaging an actuator that moves said lift pin to engage an underside of the workpiece.

5. The apparatus of claim 4 wherein said means comprises:

a lift pin flange on said lift pin; and an actuator, coupled to said lift pin flange, for driving said lift pin along said guide pin.

6. The apparatus of claim 1 further comprising:

a lift pin flange on said lift pin; and a bellows having a first end and a second end, where said first end is sealed to said lift pin flange and said second end is sealed to a pedestal.

7. An apparatus for lifting a workpiece, comprising:

a pedestal having a surface for supporting the workpiece and a plurality of lift pin bores;

a plurality of guide pins, where each respective guide pin is attached to said pedestal and coaxially aligned with a respective lift pin bore; and a plurality of lift pins, where each of said lift pins has an interior surface and an exterior surface, wherein said interior surface slideably engages a respective guide pin and is guided by said respective guide pin through a respective lift pin bore.

8. The apparatus of claim 7 further comprising:

a plurality of guide bushings, where each of said guide bushings is located in a respective lift pin bore and circumscribes a respective lift pin.

9. The apparatus of claim 8 wherein each of said guide bushings forms a lip seal.

10. The apparatus of claim 7 further comprising:

means, coupled to each of said lift pins, for engaging an actuator that lifts said plurality of lift pins to engage an underside of the workpiece.

11. The apparatus of claim 10 wherein said means comprises:

a lift pin flange on each of said lift pins; and an actuator, coupled to said lift pin flange of each of the lift pins, for driving each of the lift pins along a respective guide pin.

12. The apparatus of claim 7 further comprising:

a lift pin flange on each of said lift pins; and a plurality of bellows, each of the bellows having a first end and a second end and circumscribing a respective lift pin, where the first end is sealed to the lift pin flange of a respective lift pin and the second end is sealed to the pedestal.

13. An apparatus for lifting a workpiece, comprising:

a pedestal, having a surface for supporting the workpiece and a plurality of lift pin bores;

a plurality of guide pins, each respective guide pin being attached to said pedestal and coaxially aligned with a respective lift pin bore; and a plurality of lift pins, where each of said lift pins has an interior surface and an exterior surface, where said interior surface of each of said lift pins slideably engages a respective guide pin and is guided through a respective lift pin bore, and each of said lift pins contains a flange;

a plurality of guide bushings, where at least one guide bushing is located in each of said lift pin bores and circumscribes said respective lift pin to form a lip seal; and an actuator, coupled to the lift pin flanges, for driving each of the lift pins along each of the guide pins and thereby extending the lift pins to engage an underside of the workpiece.

14. The apparatus of claim 13 further comprising:

a plurality of bellows, each of the bellows circumscribing a respective lift pin and having a first end and a second end, where the first end is sealed to the lift pin flange of each of the lift pins and the second end is sealed to the pedestal.

* * * * *